US009016213B2

(12) United States Patent
Tajbakhsh

(10) Patent No.: US 9,016,213 B2
(45) Date of Patent: Apr. 28, 2015

(54) WORKSTATION WITH VARIABLE SPATIAL CONFIGURATION CAPABILITIES

(76) Inventor: Fariborz Tajbakhsh, Oak Park, CA (US)

( * ) Notice: Subject to any disclaimer, the term of this patent is extended or adjusted under 35 U.S.C. 154(b) by 1777 days.

(21) Appl. No.: 12/177,448

(22) Filed: Jul. 22, 2008

(65) Prior Publication Data

US 2010/0019548 A1 Jan. 28, 2010

(51) Int. Cl.
*A47B 11/00* (2006.01)
*A47B 21/00* (2006.01)

(52) U.S. Cl.
CPC ..... *A47B 21/00* (2013.01)

(58) Field of Classification Search
USPC ..... 108/1, 5–6, 9, 50.01, 94–95, 103, 105, 108/107–108, 157.1, 157.13, 158.13, 159; 312/223.3; 297/170–173, 217.3
See application file for complete search history.

(56) References Cited

U.S. PATENT DOCUMENTS

| | | | | | |
|---|---|---|---|---|---|
| 2,625,986 | A | * | 1/1953 | Siff | 108/139 |
| 3,337,262 | A | * | 8/1967 | Katzfey et al. | 297/158.4 |
| 4,880,270 | A | * | 11/1989 | Cooper | 297/188.21 |
| 5,177,616 | A | | 1/1993 | Riday | |
| 5,630,566 | A | * | 5/1997 | Case | 248/122.1 |
| 5,704,298 | A | * | 1/1998 | Corpuz et al. | 108/50.01 |
| 5,779,305 | A | | 7/1998 | Hocking | |
| 5,911,178 | A | * | 6/1999 | Alexander | 108/50.11 |
| 5,918,841 | A | * | 7/1999 | Sweere et al. | 248/123.11 |
| 6,021,535 | A | | 2/2000 | Baus et al. | |
| 6,089,663 | A | | 7/2000 | Hill | |
| 6,102,476 | A | | 8/2000 | May et al. | |
| 6,145,926 | A | | 11/2000 | Lin | |
| 6,298,794 | B1 | * | 10/2001 | Brown et al. | 108/50.01 |
| 6,386,413 | B1 | * | 5/2002 | Twyford | 224/553 |
| D467,086 | S | | 12/2002 | Steelman | |
| 6,516,729 | B1 | * | 2/2003 | Dodson et al. | 108/50.11 |
| 6,702,372 | B2 | * | 3/2004 | Tholkes et al. | 297/172 |
| 6,712,008 | B1 | * | 3/2004 | Habenicht et al. | 108/96 |
| 6,722,673 | B1 | * | 4/2004 | Hamlin | 280/47.35 |
| 6,964,370 | B1 | | 11/2005 | Hagale et al. | |
| 7,125,074 | B2 | | 10/2006 | Real et al. | |
| 2005/0188900 | A1 | | 9/2005 | Dittrich | |
| 2007/0257530 | A1 | | 11/2007 | Florez et al. | |

FOREIGN PATENT DOCUMENTS

| | | |
|---|---|---|
| EP | 0649671 A1 | 4/1995 |

* cited by examiner

*Primary Examiner* — Hanh V Tran
(74) *Attorney, Agent, or Firm* — Jafari Law Group, Inc.; David V. Jafari

(57) ABSTRACT

A workstation with variable spatial configuration capabilities. It is designed to allow a plurality of office chairs to couple to the workstation and while coupled to the workstation move in tandem with the workstation. Such coupling will allow the workstation as a whole to be portable while still efficiently supporting and effectively organizing the components of a complex computer system. The workstation further comprises of work surfaces whose placement is adjustable in multiple dimensions and provides a solid, yet portable structure to work from, while being flexible enough to allow a user selective variable spatial configuration for the user work environment.

1 Claim, 14 Drawing Sheets

WORKSTATION WITH VARIABLE SPATIAL CONFIGURATION CAPABILITIES

TECHNICAL FIELD OF THE INVENTION

The present invention relates in general to a workstation with variable spatial configuration capabilities, and more specifically, to a workstation with a universal coupling mechanism adapted to securely couple to a plurality of different types of chairs that includes various adjustable support surfaces used to hold a variety of user articles such as office and electronic components. The purpose of this workstation is to provide a solid, yet portable, ergonomically structured to work from, while being flexible enough to allow for a user-selected variable spatial configuration for their work environment.

COPYRIGHT & TRADEMARK NOTICE

A portion of the disclosure of this patent application may contain material that is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

BACKGROUND OF THE INVENTION

Typically a workstation will comprise of a chair and desk combination, where the desk will normally be used to organize and support a computer and the computer's components while they are being used.

Workstations come in a variety of sizes, depending upon the amount of space available in the location where the workstation is being placed, stylistic qualities of the workstation, and the weight requirements of the user components that the workstation supports.

With the increase in the number of components being connected to computer systems it is becoming more and more difficult to have an organized workspace, which will optimize office space usage and still have the ability to use the various different components required to operate the computer system freely. Thus in order to freely and effectively use each individual user component, there is a need for a workstation that can situate the components effectively while not interfering with components being used.

Furthermore, computer use has become a common activity increasingly taking up more and more time of people's life and has recently become a lifestyle changing activity, both in working environments and at home. Thus, current workstations or office spaces are inadequately configured so that such old devices or spatial configurations of work environments do not properly address the physical and mental stress created by the repeated and constant use of computer systems for long periods of time, typically creating stress on the hands, shoulder, neck, and back.

Along with the organizational issues of workspaces, the costs associated with the time spent moving workstations and their associated computer components can become great, depending upon the complexity of the system and the frequency that these stations are being moved. Therefore, there is a demand for a workstation that is adaptable and can be easily and quickly configured, particularly for a dynamic work environment.

For example, non portable workstations placed in classroom and business environments would require disassembly and reassembly each and every time the workstation is taken to a different location. To overcome the cost and hassle associated with constant assembly and disassembly of workstations, extra workstations and equipment are often purchased. The use of an effective portable workstation in these circumstances would decrease costs by eliminating the need for extra workstations. The use of a portable workstation will also free up space in areas where these extra workstations had been.

Portability also plays a large factor in the efficiency of those using the workstation. There is a growing need for a workstation that can move with the user in situations where there is information that needs to be accessed from the workstation while performing tasks in multiple locations. There is a need in the art for a workstation which can move readily and easily with its user. This in turn will increase user efficiency.

Therefore, there is a need in the art for a workstation with both the ability to organize a growing number of components and one that is portable, as to preserve space, increase the efficiency of those using the workstation, and reduce the amount of equipment needed to perform the tasks desired. The present invention overcomes the above described disadvantages of the prior art. It is to these ends that the present invention has been developed.

SUMMARY OF THE INVENTION

To minimize the limitations in the prior art, and to minimize other limitations that will be apparent upon reading and understanding the present specification, the present invention describes a workstation with a universal coupling mechanism adapted to securely couple to a plurality of different types of chairs, including various adjustable articulated arms coupled to support surfaces used for supporting a variety of user articles, for example, computer equipment.

A workstation in accordance with the present invention comprises a unique universal connector, which allows a user to latch a variety of office chairs to the base. This in turn will allow the workstation and chair to move in tandem. The purpose of this workstation is to provide a solid, yet portable structure to work from, while being flexible enough to allow for the variety of different sized components and individuals who will be utilizing the workstation.

An exemplary embodiment of the present invention, a workstation comprises a base including a universal coupling mechanism adapted to securely couple to a plurality of different types of chairs. Said universal coupling mechanism is adapted to securely couple to a vertical support member of said plurality of chairs. The base further includes a power interface to provide power to user articles, and a plurality of rollers attached to the base for transporting the invention. Extending vertically from the base and securely coupled to the base is a post. Coupled to the post are one or more support members, wherein each supporting member is adapted to support said user article. The support members are user adjustable in a substantially lateral and rotational direction, with a range substantially over 280 degrees.

In order for the support members to move rotationally, the support member contains an articulated arm. The articulated arm comprises a first member rotationally coupled to the post and a second member rotationally coupled to the first member. The support members further include a substantially horizontal or vertical surface used to support one or more computer components rotationally coupled to the articulated arm. These support surfaces are user adjustable via lateral and vertical pivoting.

Along with being user adjustable in a lateral direction, the support members may also be adjustable in a vertical direction.

In another exemplary embodiment, the present invention comprises a base and a post extending generally vertical from, and securely coupled to, said base. Coupled to the post are one or more support members, wherein each supporting member is adapted to support user components. The support members are user adjustable in a substantially lateral and rotational direction, with a range substantially over 360 degrees. In order for the support members to move rotationally, the support member contains an articulated arm. The articulated arm comprises a first member rotationally coupled to the post and a second member rotationally coupled to the first member. The support members further include a substantially horizontal or vertical surface used to support one or more computer components rotationally coupled to the articulated arm. These support surfaces are user adjustable via lateral and vertical pivoting. Along with being user adjustable in a lateral direction, the support members may also be adjustable in a vertical direction.

It is an objective of the present invention to provide users with the ability to freely move components supported by the workstation in various directions so as to adapt the workstation to a variety of spatial configurations.

It is another objective of the present invention to provide users with an organized and efficient workstation for use of a computer and its components.

It is yet another objective of the present invention to provide users with a workstation, which would decrease the costs of assembly and reassembly and decrease the number of workstations needed to perform a particular task.

It is yet another embodiment of the present invention, to provide a workstation that may be used with a variety of chairs by implementing a universal chair coupling mechanism.

It is yet another objective of the present invention to provide electronic actuation and automatic movement of workstation components, to allow a user to variably arrange the workstation's spatial configurations from a localized user interface.

It is yet another objective of the present invention to provide a workstation that may be used independently or in conjunction with a desk.

It is yet another objective of the present invention to provide a workstation that may be configured change for both left handed and right handed users.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1(*b*) illustrates the base in accordance with the embodiment disclosed in FIG. 1(*a*), which has been adapted to receive a variety of chairs by implementing a universal coupling mechanism in accordance with one embodiment of the present invention, and a universal coupling clip to provide rear support to the chair, which is coupled to the workstation.

FIG. 1(*c*) illustrates a close up view of the components shown in FIG. 1(*a*) that provide such embodiment of the workstation with transportation capabilities, structural support, and a power supply for either the workstation itself, or the user articles used therewith.

FIG. 1(*d*) illustrates a close up view of the components shown in FIG. 1(*a*) that provide such embodiment of the workstation with structural support for user articles, for example a support surface for a display.

FIG. 2(*b*) illustrates a more detailed look at one component of an articulated arm, in accordance with the present invention.

FIG. 2(*c*) shows a top view of an alternative embodiment as illustrated in FIG. 2(*a*), equipped with adjustment levers coupled to and between a support surface and a pivoting joint so as to allow for up and down movement of said support surface around the pivot axel of said pivoting joint and arm support member.

FIG. 2(*d*)-FIG. 2(*f*) show side views of the embodiment equipped with adjustment levers described and illustrated in FIG. 2(*c*), depicting several different positions achieved by adjustment of the adjustment levers in accordance with one embodiment of the present invention.

FIG. 2(*g*) shows a top view of another similar embodiment, wherein support member 201 is a vertical support surface also equipped with adjustment levers coupled to and between a support surface and a pivoting joint so as to allow for up and down movement of said support surface around the pivot axel of said pivoting joint and arm support member.

FIG. 2(*h*)-FIG. 2(*j*) show side views of the embodiment equipped with adjustment levers described and illustrated in FIG. 2(*g*), depicting several different positions achieved by adjustment of the adjustment levers in accordance with one embodiment of the present invention.

FIG. 3(*b*) illustrates a standing platform for utilizing said workstation in an environment wherein a standing position is required.

DETAILED DESCRIPTION OF THE DRAWINGS

In the following discussion that addresses a number of embodiments and applications of the present invention, reference is made to the accompanying drawings that form a part hereof, where depictions are made, by way of illustration, of specific embodiments in, which the invention may be practiced. It is to be understood that other embodiments may be utilized and changes may be made without departing from the scope of the present invention.

Figure 1A:
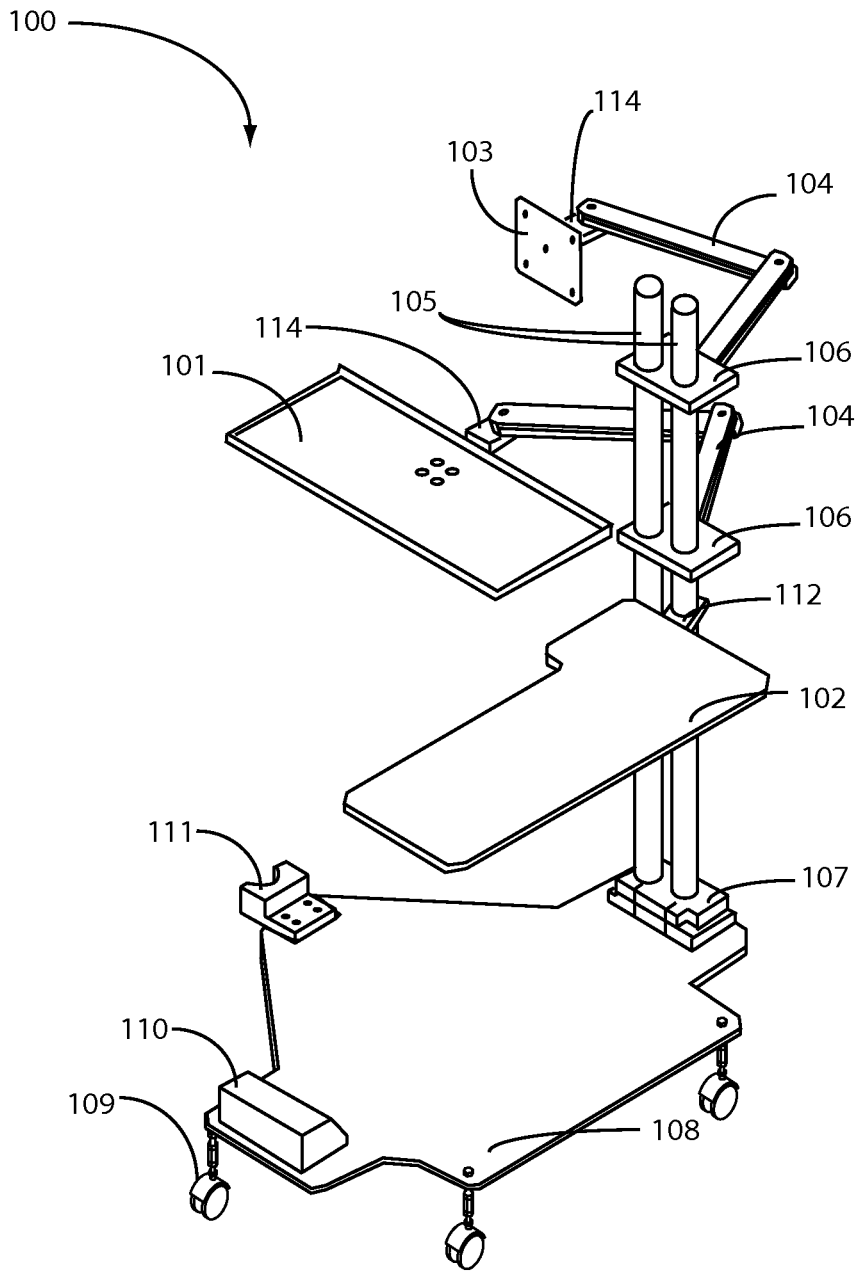
FIG. 1(*a*) illustrates an overview diagram of a workstation with a variable spatial configuration system, in accordance with one embodiment of the present invention, comprising of a base including a universal coupling mechanism adapted to securely couple to a plurality of different types of chairs and several articulated arms and surfaces for supporting user articles such as a keyboard, a mouse, a computer and a display.
Figure 1B:
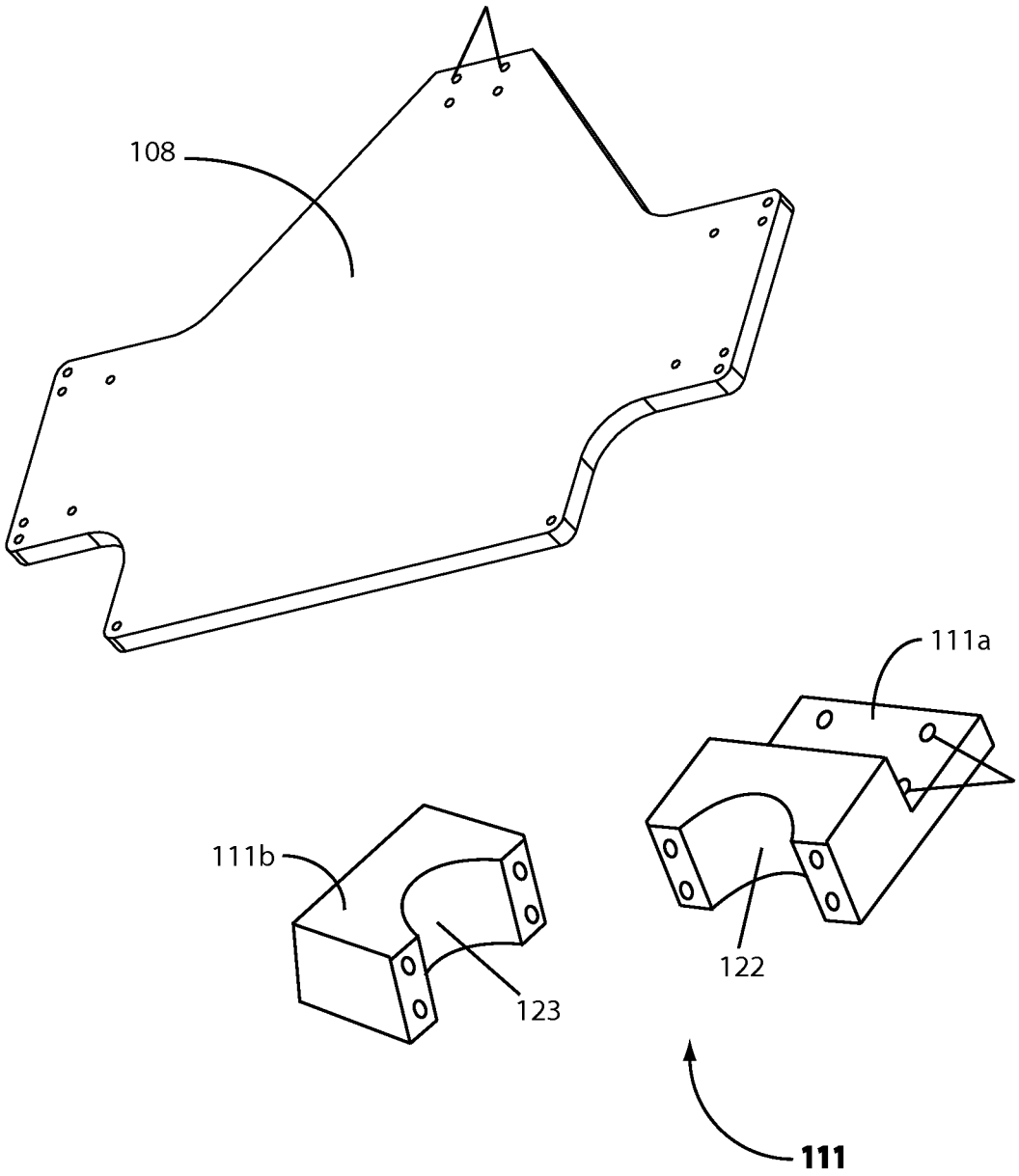
Figure 1:
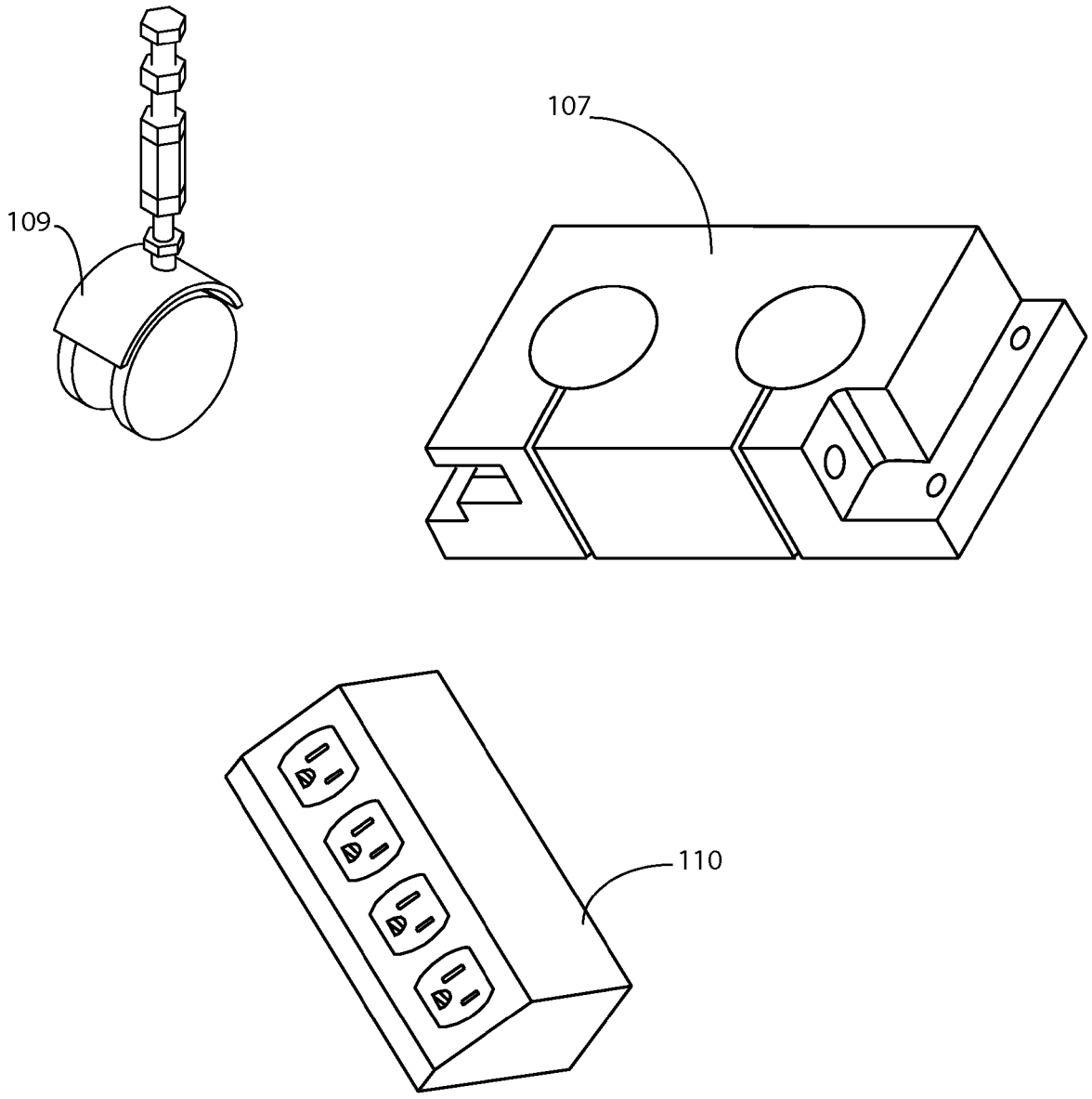
Figure 1D:
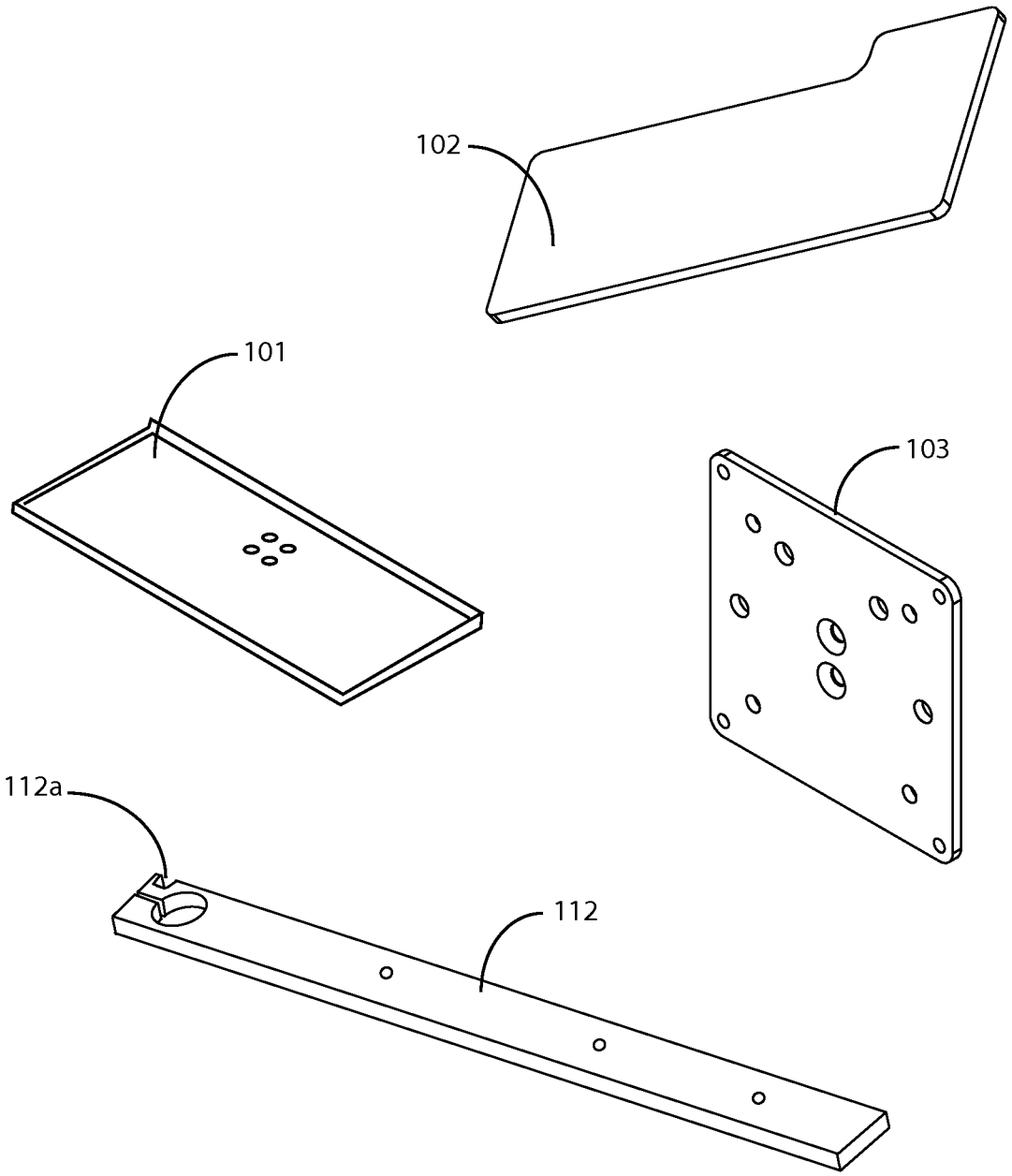
Figure 2A:
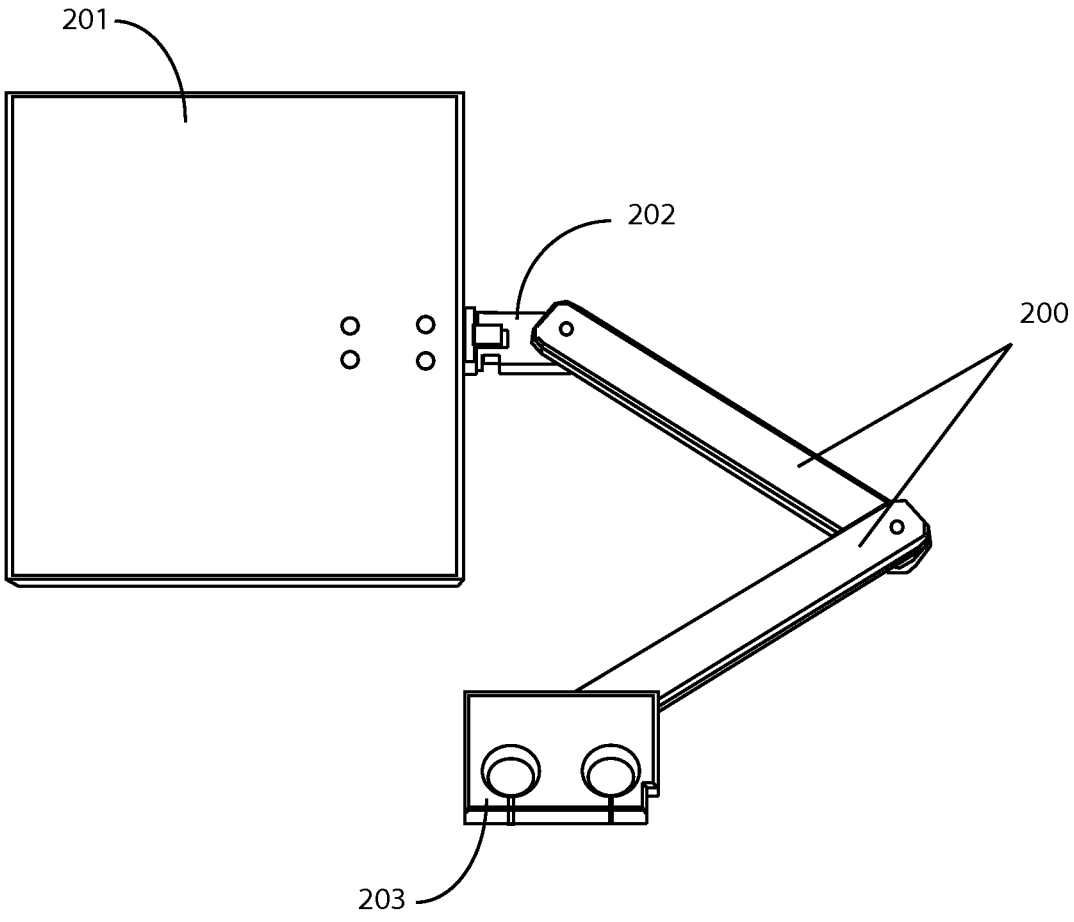
FIG. 2(*a*) illustrates an articulated arm and a support surface in accordance with one embodiment of the present invention. It may be used to support a user article, for example a laptop computer, and may be configured for a variety of applications including mechanical and/or automatic adjustment control capabilities.
Figure 2B:
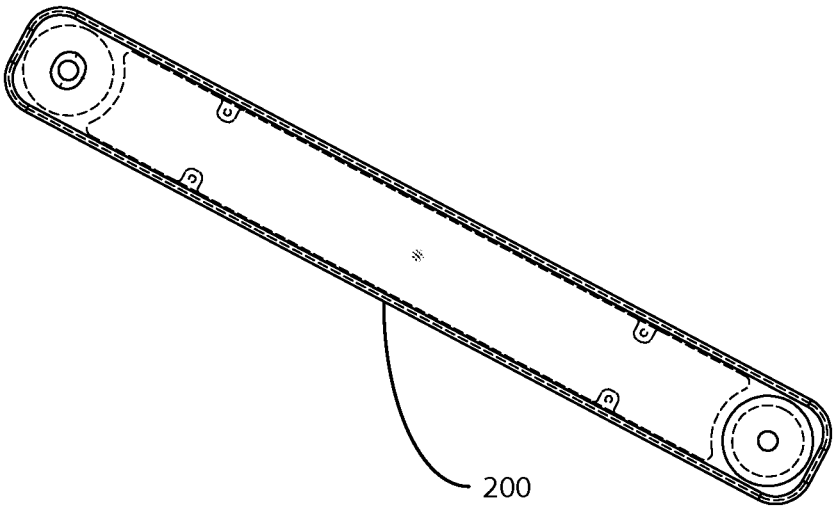
Figure 2B:
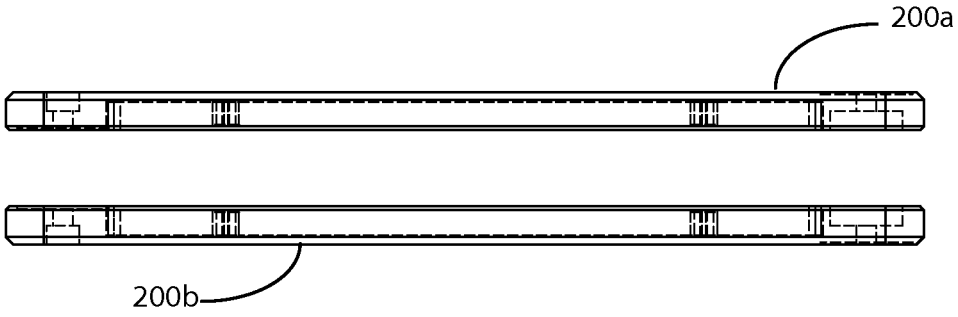
Figure 2C:
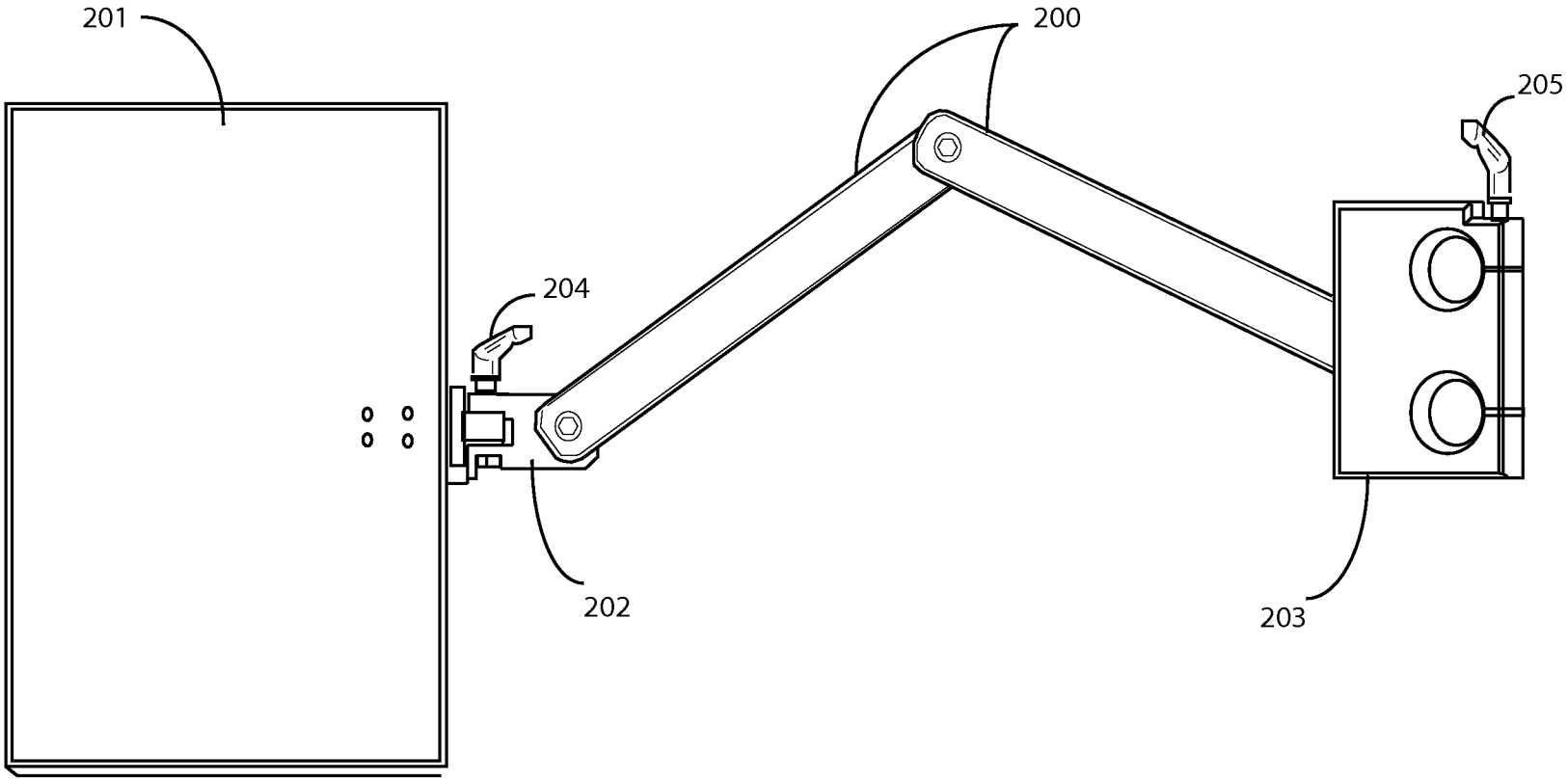
Figure 2D:
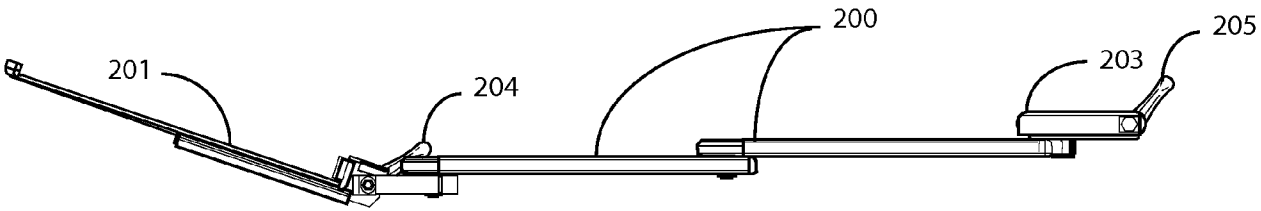
Figure 2E:
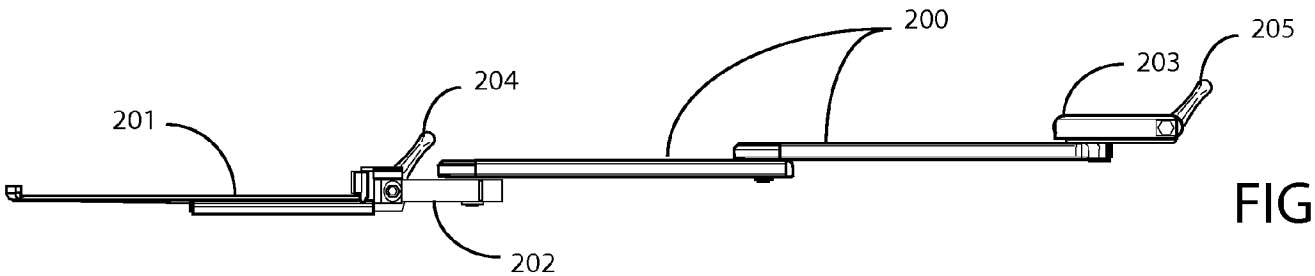
Figure 2F:
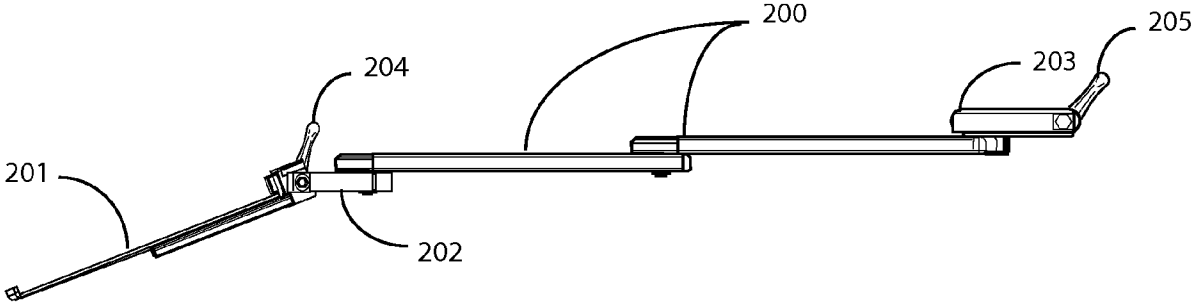
Figure 2G:
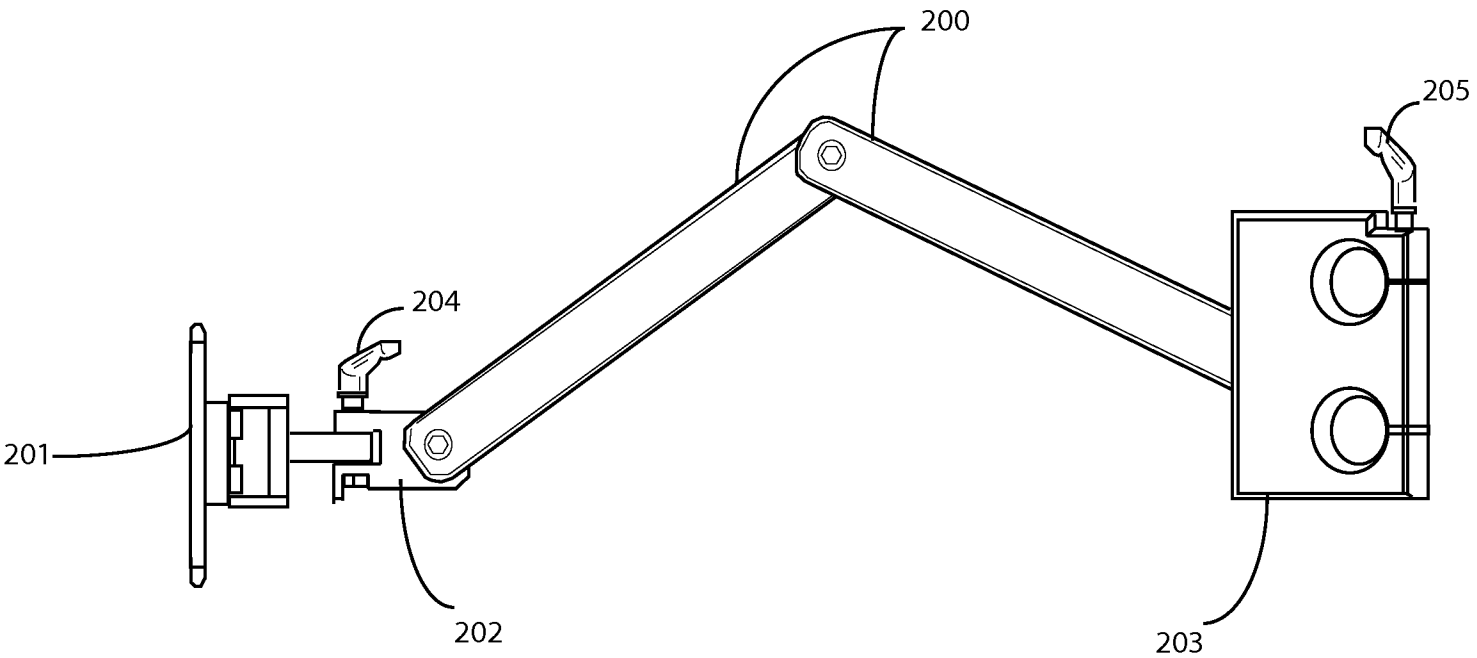
Figure 2H:
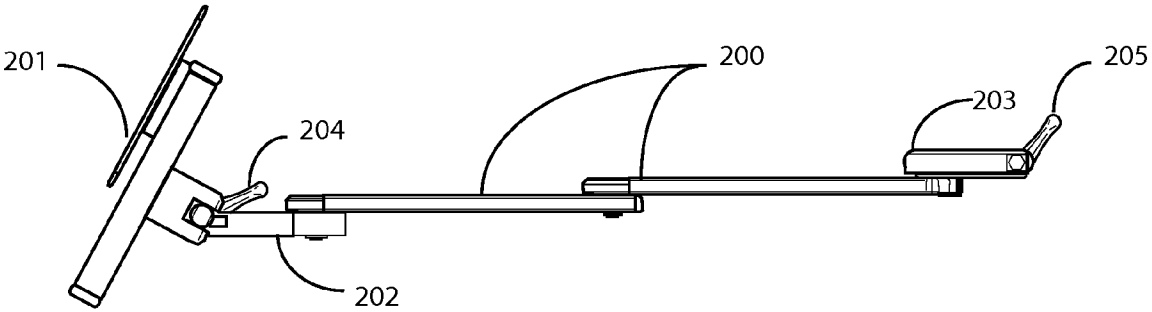
Figure 2I:
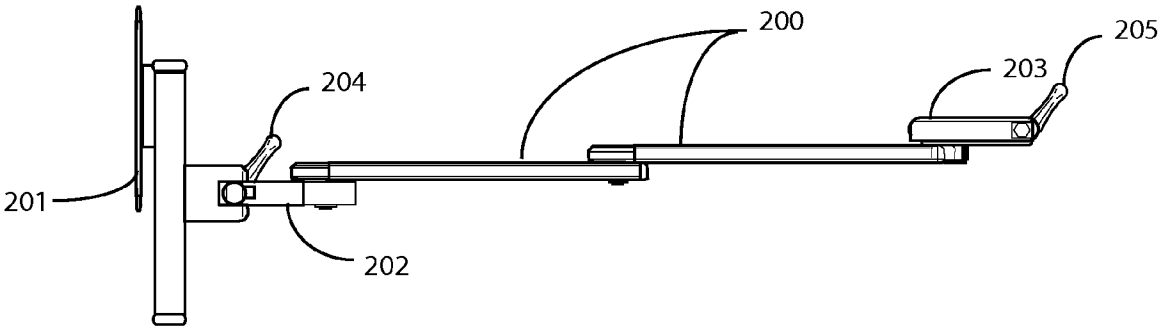
Figure 2J:
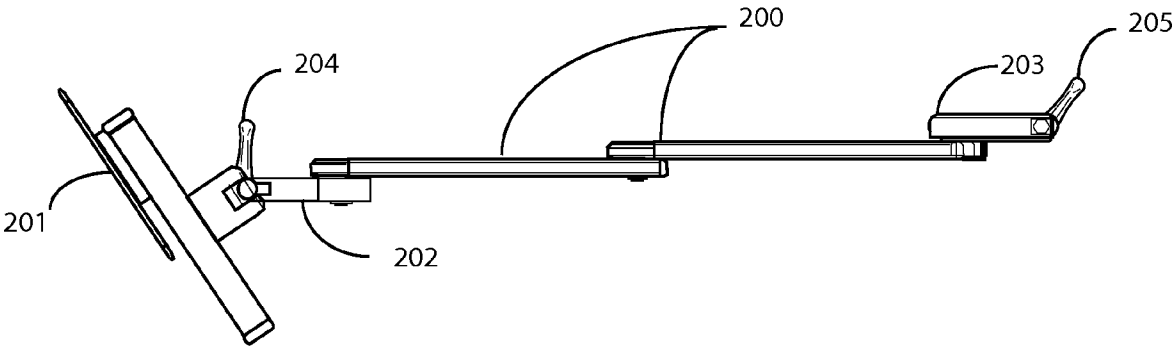

FIG. 1(*a*) illustrates an overview diagram of a workstation with a variable spatial configuration system, in accordance with one embodiment of the present invention, comprising of a base including a universal coupling mechanism adapted to securely couple to a plurality of different types of chairs and several articulated arms and surfaces for supporting user articles such as a keyboard, a mouse, a computer and a display.

Specifically, FIG. 1(*a*) shows an overview diagram of the different components for workstation 100, which includes support surfaces 101, 102, and 103, articulated arms 104, posts 105, arm couplings 106, posts support block 107, base 108, rollers 109, power interface 110, and universal coupling mechanism 111.

Base 108 consists of a solid material, which may be used to provide support and structure to the workstation. Attached to base 108, are rollers 109, power interface 110, universal coupling mechanism 111, and posts support block 107.

Typically, base 108 may be formed of a rigid type of solid material. Without limiting the scope of the invention, base 108 may include, among other materials, plastics, metals, wood, or fiberglass. However, base 108 should use a strong enough material to support the weight of workstation 100 and any components that workstation 100 supports. The base need also be rigid enough to endure the force exerted either in a pushing or pulling type motion by the user.

In the present embodiment shown, base 108 is configured in such way that posts support blocks 107 may be switched with power interface 110, so that workstation 100 may be used in conjunction with furniture placed either on the left side of the user, or the right side of the user as well; thereby making workstation 100 interchangeable to user preferences with respect to both a desired spatial configuration and a choice of utilizing workstation 100 independently or in conjunction with other office components such as another desk, table, or any other office furniture.

Rollers 109 are coupled to base 108 in a manner so that workstation 100 may be easily transported from one location to the next. Rollers 108 may be directed away from base 108 towards the floor to allow the workstation to move freely, as shown in FIG. 1. Power interface 110, and post block 107 are attached on opposite sides on the top of base 108.

In one embodiment, rollers 109 comprise of wheels attached to base 108. Rollers 109 may be used to provide movement in any lateral direction and may be configured in a manner so that they are able to sustain the weight of the workstation while the workstation is being moved.

Typically, power interface 110 is attached to base 108 and consists of a solid structure containing electrical outlets to provide electricity to the workstation. However, without limiting the scope of the present invention, variations of power interface 110 could include an extension cord or open circuits designed to provide power to user articles. In an exemplary embodiment, power interface 110 comprises a power strip with a 9 ft electric cord to plug into a wall's electrical socket.

Posts support block 107 consists of a solid material used to support posts 105 and attach posts 105 to a top portion of base 108. Posts support block 107 may be securely coupled to base 108 and may be made of any type of material durable enough to hold the posts in place and not only bear the load of the workstation, but also any user and/or user articles supported by workstation 100. In alternative embodiments, posts support block 107 may consist of wood, fiberglass, plastic, metal, or any other material adequate to properly support posts 105.

Universal coupling mechanism 111 also attaches to a top portion of base 108, for example, on the edge of base 108 as shown in FIG. 1. In one embodiment, universal coupling mechanism 111 is designed as a two component device; however, universal coupling mechanism 111 may comprise a single unit, or a unit with more than two parts, without limiting the scope of the present invention.

Posts 105 are solid or hollow tubes in form and are connected vertically and perpendicular to base 108. Attached to posts 105 is a support arm 112 for supporting support surface 102. Support arm 112 may be used to rotationally couple support surface 102 to one of posts 105 and provide support to support surface 102 or any other additional support surface (not shown) that may be further implemented with workstation 100.

Support surface 102 is typically made from a rigid type material that can be used to support a user article. Without limiting the scope of support surface 102, may be used for holding a variety of office or computer components. For example, and without limiting the scope of the present invention, support surface 102 may be used to support mouse type computer components.

Also, connected to posts 105 is at least one arm coupling 106. Further, attached to arm coupling 106 is articulated arm 104. The combination of arm coupling 106 and articulated arm 104 may be desirable configuration so as to allow articulated arm 104 to be moved in both a vertical and lateral direction. Further attached to articulated arm 104 is horizontal pivot 114, which allows for further lateral movement of support surface 101 and or 103.

The combination of arm coupling 106, articulated arm 104, and horizontal pivot 114, are not only designed to provide for adjusting the support surfaces 101, and 103, but also to provide support to the support surface and the user articles. Again, arm coupling 106, articulated arm 104, and horizontal pivot 114, and may be constructed wood, metal, fiberglass, plastic, metal or any combination of materials adequate to provide the required support for a user and user articles placed on workstation 100.

Typically, support surface 101, 102 and 103 are designed to support user articles such as a key board, mouse components, and a display (respectively), however, other user articles may be incorporated with workstation 100 without deviating from the scope of the present invention. A more detailed description of such embodiment is discussed with reference to FIG. 2.

Turning to the next figure, FIG. 1(*b*) illustrates a base in accordance with the embodiment disclosed in FIG. 1(*a*), which has been adapted to receive a different variety of chairs by implementing a universal coupling mechanism in accordance with one embodiment of the present invention, and a universal coupling clip to provide rear support to the chair, which is coupled to the workstation.

In an exemplary embodiment, universal coupling mechanism 111 is universally adapted to securely couple to a vertical support member of a chair, for example, the support section of a chair that runs from a wheeled base of the chair to a bottom portion of the chair. This is desirable so that any number of chairs may be coupled or used with workstation 100.

In such exemplary embodiment (as shown), universal coupling mechanism 111 further includes two components: a fixed member 111*b*, which may be securely coupled to base 108, said fixed member 111*a* having a recess 122 adapted to receive a portion of said vertical support member of a chair (not shown); and a second detachable member 111*b* also having a recess 123 adapted to receive a portion of the chair's vertical support member, which may be securely coupled to the fixed member so as to hold the chair in place and allow a user to use that chair with workstation 100.

Universal coupling mechanism 111 maybe made of a solid material such as metal, wood, or plastic, which would be durable enough to sustain the force exerted by the chair when the workstation is moving, or any other suitable material without limiting the scope of the present invention.

Next, FIG. 1(*c*) illustrates a close up view of the components shown in FIG. 1(*a*) that provide such embodiment of a workstation with transportation capabilities, structural support, and a power supply for either the workstation itself, or the user articles used therewith. The shown components include rollers 108, here shown in one embodiment as a plurality of a wheel design commonly known in the art; power interface 110, here shown in one embodiment as a power box to provide workstation 100 with an electrical power source from, for example a battery or an electrical socket; and posts support block 107, here shown in one embodiment as a base post clip for connecting a pair of posts 105 to base 108.

FIG. 1(*d*) illustrates a close up view of the components shown in FIG. 1(*a*) that provide such embodiment of the workstation with structural support for user articles, for example a support surface for a display.

The shown components include: support surface 101, here shown in one embodiment designed for use with a keyboard device; support surface 102, here shown in one embodiment designed for use with mouse components; support surface 103, here shown in one embodiment as a monitor bracket for supporting a monitor or display; and support arm 112, here shown in one embodiment, designed to couple support surface 102 to posts 105 and support the load of any user article (s) being utilized on support surface 102, having a connection port 112*a* that may be adjusted in both a horizontal and vertical directions depending on the user's preference.

In one embodiment, support arm may be adjusted manually, for example by loosening and/or tightening a bolt (not shown) through end openings 112*b*, and thereby allowing free movement of support arm 112; upon reaching a desired position, a user may tighten support arm 112 into a fixed, stable position.

In another embodiment, support arm 112 may be coupled to posts 105 in a manner so as to be mechanically connected and allow a user to automatically adjust its position. Such embodiment, as well as other motorized embodiments will be discussed below particularly with respect to one embodiment of the present invention, which utilizes motorized articulated arms.

FIG. 2(*a*) illustrates an articulated arm and a support surface in accordance with one embodiment of the present invention. It may be used to support a user article, for example a laptop computer, and may be configured for a variety of applications including mechanical and/or automatic adjustment control capabilities.

Support surface 201 as shown may be attached to articulated arm 200 using any type of known joint, however, in the shown embodiment, articulated arm is coupled to support surface 201 via a pivoting joint 202. This configuration is desirable for greater mobility and adaptability to a user's preferred spatial configuration. Articulated arm 200, is typically designed to allow movement in the lateral directions around the supporting posts (i.e. posts 105) as shown in FIG. 1. However, in alternative designs it may be desirable to allow lateral and vertical movement, for example if support surface 201 is used vertically to support a display—the advantage being that a user may then be ably to adjust said display by pivoting up, down, laterally and diagonally, depending on that user's preferences for a desired spatial configuration.

Furthermore, articulated arm 200 is also coupled to arm support member 203. Arm support member 203 allows for further support of support surface 201 and is the adjoining component which allows vertical movement of articulated arm 200 (i.e. up and down posts, for example posts 105, as shown in FIG. 1).

The combination of both articulated arm 200 and arm support member 203 allows for support surface 201 to have full range of both vertical and horizontal movement, fully adjustable depending on the application to which articulated arm 200 is implemented in.

Arm support member 203, in accordance with either of the embodiments disclosed herein may be designed for use with any type of support surface. For example and without limiting the scope of the present invention, articulated arm 200 may be used to control movement of a horizontal support member, or a vertically oriented support member such as support member 103 shown and describe with reference to FIG. 1.

FIG. 2(*b*) illustrates a more detailed look at one component of an articulated arm, in accordance with the present invention. Specifically, showing a cross sectional view of articulated arm 200 wherein it is shown, in one embodiment of articulated arm 200, the typical inside workings of such known mechanics. In an exemplary embodiment articulated arm 200 includes a hollow shell to protect, hide and rout any circuitry or wires inside articulated arm 200, depending on the embodiment used therewith.

In this embodiment, articulated arm comprises of two separate components 200*a* and 200*b* that conceal the mechanism which allows articulated arm 200 to move laterally. Because this is known technology and typically know in the art, this disclosure will not go into further detail of the workings of a typical articulated arm.

Nevertheless, it will not be deviating from the present invention to implement an articulated arm that uses several types of joints and allows for a variable movement capacity. For example, and without limiting the scope of the present invention, articulated arm 200 could cause a support surface to pivot up, down, move vertically, move horizontally, and even rotate.

For example, FIG. 2(*c*) shows a top view of a similar embodiment equipped with adjustment lever 204 coupled to and between support surface 201 and pivoting joint 202 so as to allow for up and down movement of support surface 201 around the pivot axel of pivoting joint 202. Furthermore, adjustment lever 205 may also be placed at arm support members 203 for further motion control.

Adjustment levers 204 and 205 may be desirable to not only allow adjustment of support surface 201, but may too be implemented for pivoting a vertical support surface such as support member 103 shown and describe with reference to FIG. 1.

FIG. 2(*d*)-FIG. 2(*f*) show side views of the embodiment equipped with adjustment levers described and illustrated in FIG. 2(*c*), depicting several different positions achieved by adjustment of the adjustment levers in accordance with one embodiment of the present invention.

FIG. 2(*g*) shows a top view of another similar embodiment, wherein support member 201 is a vertical support surface also equipped with adjustment levers coupled to and between a support surface and a pivoting joint so as to allow for up and down movement of said support surface around the pivot axel of said pivoting joint and arm support member.

FIG. 2(*h*)-FIG. 2(*j*) show side views of the embodiment equipped with adjustment levers described and illustrated in FIG. 2(*g*), depicting several different positions achieved by adjustment of the adjustment levers in accordance with one embodiment of the present invention.

Figure 3A:
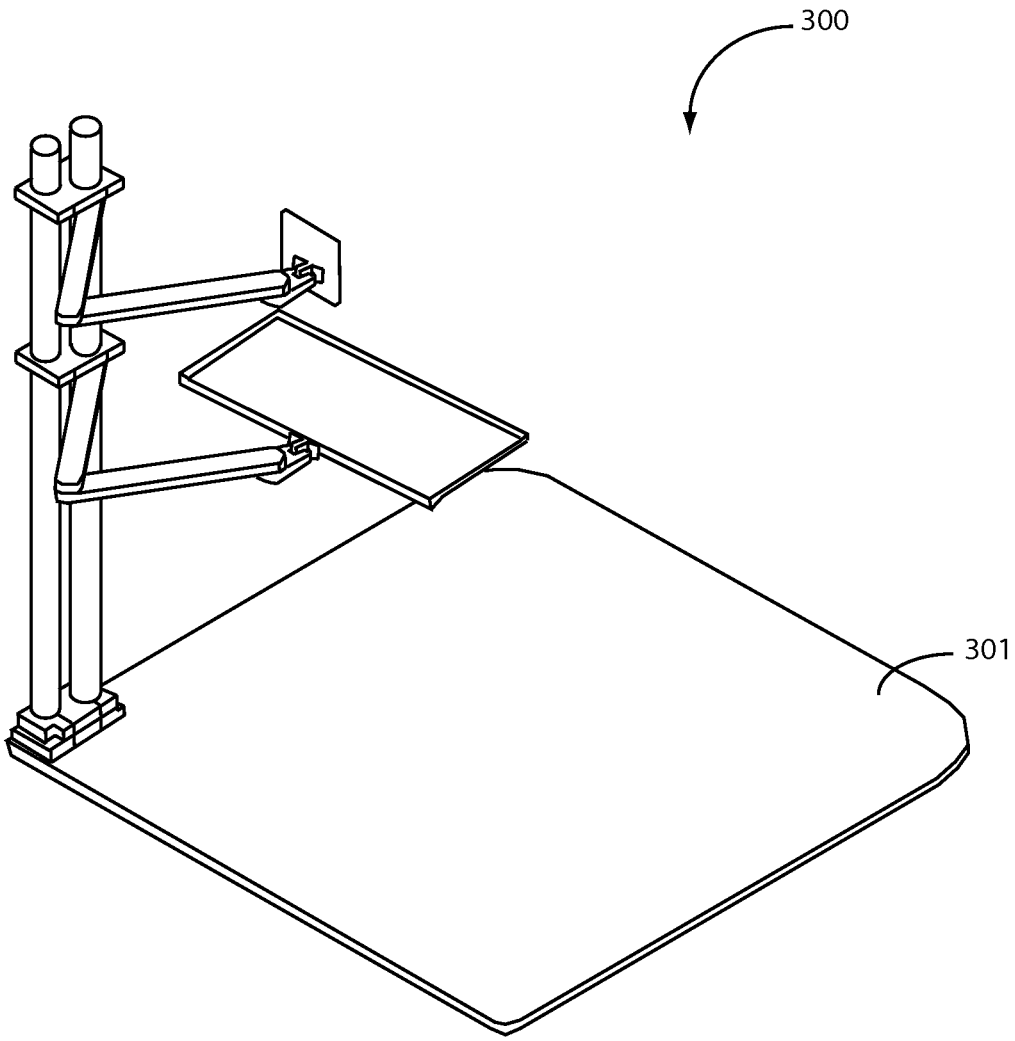
FIG. 3(*a*) illustrates an overview diagram of a workstation, in accordance with another embodiment of the present invention, wherein a flat base is used to provide a user with a standing platform for utilizing said workstation, or for a user to implement a variety of chairs, for example a lounge chair.
Figure 3B:
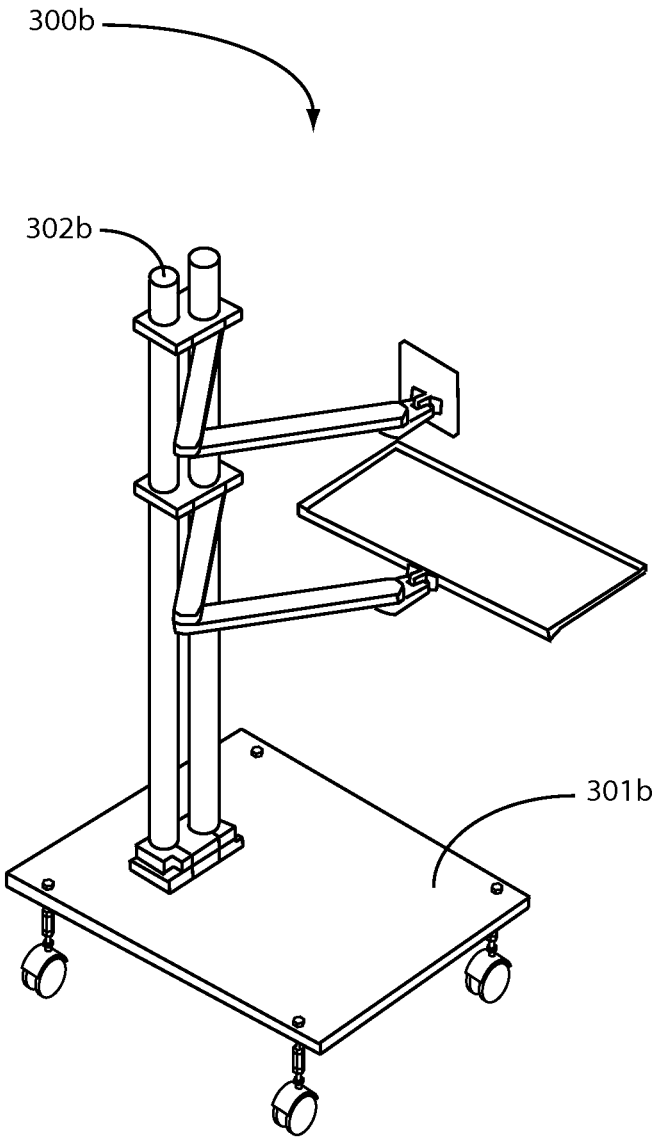

Turning to the next figure, FIG. 3(*a*) illustrates an overview diagram of a workstation, in accordance with another embodiment of the present invention, wherein a flat base is used to provide a user with a platform that goes under the lounge chair or recliner chair. Similarly, FIG. 3(*b*) illustrates a standing platform for utilizing said workstation in an environment wherein a standing position is required.

In an exemplary embodiment, the workstation as shown in FIG. 3(*a*) would be used with a chair, but would not be connected in any way to the chair (not shown). The chair would may be any type of chair and obviously freestanding on top of flat platform 301. Workstation 300 is identical to workstation 100 except base 301 is used instead of base 108. This embodiment may be desirable for a more relaxed work environment or to allow different users to exchange their preferred chair configuration with ease.

Without limiting the scope of the current invention, base 301 typically comprises of a solid rigid material that can sustain the weight of the workstation and the user articles the workstation is designed to support. In no way is this list exhaustive, but materials comprising base 301 may include materials such as metal, wood, plastic, fiberglass, or any combination thereof.

In an alternative embodiment, as shown in FIG. 3(*b*), base 300*b* is of a much smaller perimeter and workstation 300*b* is situated in a substantially centered position, wherein a flat rigid transportable base 300*b* is configured for a standing user to utilize. In such embodiment (as shown) workstation 300*b* bay be configured so that workstation 300*b* may too be used by either a left handed or right handed individual. In yet another embodiment of workstation 300*b*, workstation 300*b* is situated in a centered position and articulated arms may be shorter and extended directly away from posts 302*b*.

Either of said alternative embodiments may implement wheels or rollers 302*b* to move base 301*b*, thereby allowing a user to transport workstation 300 from one location to another. Such embodiments of the present invention which particularly focus on a standing working environment may be desirable for businesses wherein attending clients and/or processing of customers necessitates a standing position. Such workstations may be advantageous over non-transportable workstations in that computer software, data, or user preferences need not be reconfigured, but a user instead may relocate said workstation to their new location.

Figure 4:
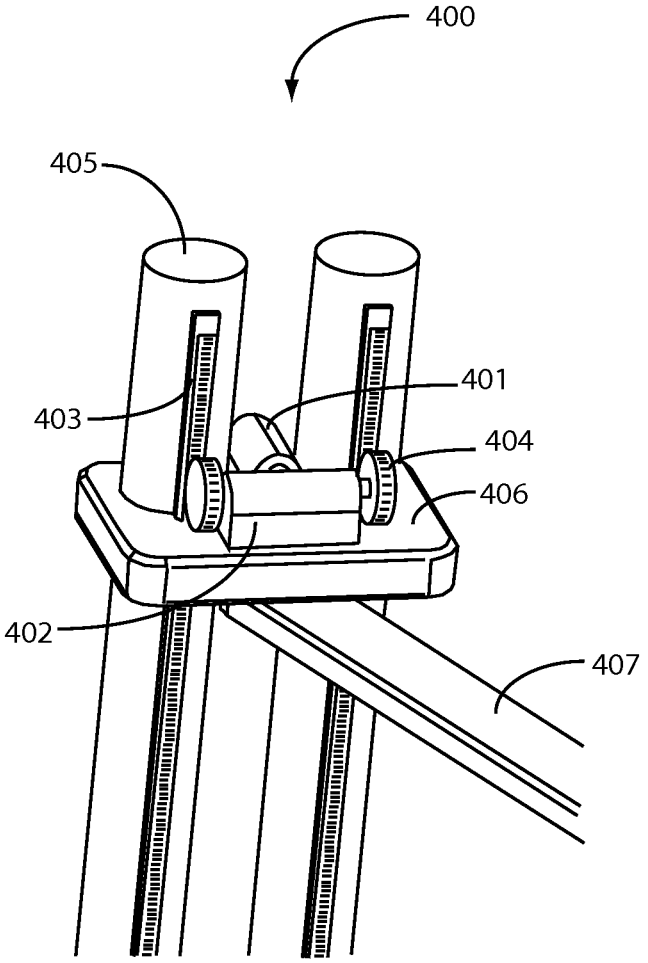
FIG. 4 illustrates another exemplary embodiment, wherein a controller and user interface are implemented and the workstation is configured for automatic adjustment, including posts adapted with tracks and motorized gearing to move and adjust the positioning of its various articulated arms and support surfaces.

FIG. 4 illustrates an exemplary embodiment, wherein a controller and user interface are implemented and the workstation is configured for automatic adjustment, including posts adapted with tracks and motorized gearing to move and adjust the positioning of its various articulated arms and support surfaces.

Specifically, FIG. 4 illustrates a close-up view of the posts adapted with tracks and motorized gearing to move and adjust the positioning of the various articulated arms and support surfaces of workstation 400.

Workstation 400 is similar to workstation 100; however it is motorized and utilizes a user interface to allow automatic adjustments without the need for a user to manually configure the positioning of each and every articulated arm, support surface, etc.

Similar to workstation 100, workstation 400 comprises posts 405, however each of said posts 405 further comprises of a track 403 for guiding guide wheels 404 in a substantially vertical direction and thereby allowing articulated arm support 406 to give articulated arm 407 a vertical movement (e.g. up and down posts 405).

In the shown embodiment, this is achieved by utilizing a set of two motors 401 and 402 to adjust articulated arm 407's positioning per a user's desired spatial configuration. Motor 401 is mechanically connected to articulated arm 407 in a manner so that articulated arm moves in a lateral direction. Motor 401 achieves this by rotating a mechanical component of articulated arm 407 to allow movement (for example, across a horizontal axis) in a rotating motion. Complimentary to motor 401, motor 402 is mechanically coupled to guide wheels 404 in a manner so that rotation of motor 402 moves articulated arm support 406 up and down posts 405 guided by track 403; a change in direction of a rotation of motor 402 logically achieves said vertical movement.

Figure 5:
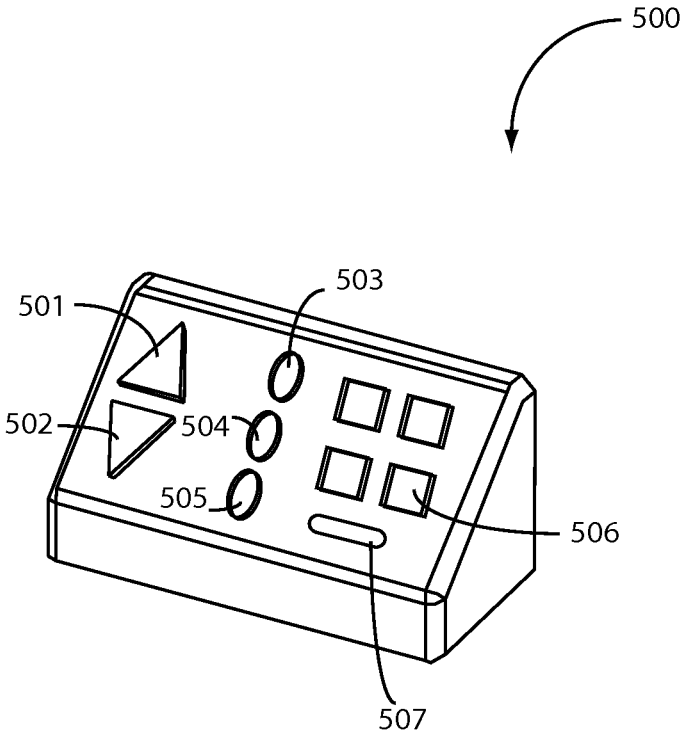
FIG. 5 illustrates one embodiment of a user interface in accordance with an exemplary embodiment for a motorized workstation.

FIG. 5 illustrates one embodiment of a user interface in accordance with an exemplary embodiment for a motorized workstation such as the embodiment illustrated and described in reference to FIG. 4.

User interface 500 is typically a controller with user inputs to allow for different actuation of workstation 400. In the shown embodiment, user interface 500 comprises of an up button 501, a down button 502, input controls 503, 504, and 505; and programming inputs and executing buttons 507 and 506 respectively.

In an exemplary embodiment, buttons 501 and 502 are used to for example control up and down movement of each articulated arm on a workstation in accordance with the present invention. Buttons 503, 504, and 505 are used to control which articulated arm is being used. Without limiting the scope of the present invention, button 503 may be a monitor button, button 504 may be a keyboard button, and button 505 may be a park button; such that each articulated arm corresponding to the user article (i.e. the keyboard button controls use of the arm adjusting a support surface being used with a keyboard) moves independently to go up and down, and also go left or right depending on which input a user has pressed.

For example, and without limiting the scope of the present invention, user interface 500 may function as follows: first a user presses the monitor or keyboard switch or button 503 or 504, then presses the UP and Down switches or button 501 and/or 502, to move each arm up or down independently. Upon leaving the workstation, a user may press button 505 or park button and the monitor and keyboard will move itself to the side of the posts to clear the way for the user to stand up and leave the workstation.

In another exemplary embodiment, programming buttons 506 and 507 may be used for programming different spatial configurations, for example, when more than one or several users will be utilizing the same workstation.

For example, and without limiting the scope of the present invention, if a single workstation is for an entire family or several employees, then each user may program and adjust the position of the arms to the user's selective preferences such as their size, shape, or otherwise desired spatial configurations.

In one embodiment, and without limiting the scope of the present invention, a user may press input button 507 and set or program their desired adjustments. At a later time, that same user may input or press one of the four buttons 506 which represents their programmed configuration, and the workstation will revert or convert the articulated arms to reflect said desired mode.

Naturally, such user interface will further comprise of a processor and memory capability, perhaps with minimal firmware. However, implementing other more complex software and hardware for similar purposes would not deviate from the scope of the present invention.

Furthermore, user interface 500 is merely an example of one embodiment for such user interface. A user interface in accordance with the present invention may also include a joystick, a key pad, a set of input devices, a combination thereof, or any other type of interface that may be used to control and program settings for a user's desired spatial configuration of the workstation.

In yet other embodiments, still other devices and useful support surfaces may be implemented. For example, and without deviating from the scope of the present invention, workstation 400 may further include additional holders, containers, and devices such as USB ports for facilitating implementation of a variety of user articles.

Further-still, workstation 400 may implement other known technology such as Bluetooth™ technology for wirelessly connecting user articles to workstation 400, including a wireless user interface; by way of example, a wireless mouse in combination with a processor, memory and graphical user interface may provide a workstation with the desired control capabilities described above.

Again, many variations of the present invention may be implemented into numerous embodiments. It may be desirable that all components used in the present invention be constructed so as to sustain the weight of the user articles being supported and yet at the same time be light enough that weight does not place any excess burden upon the user when trying to transport the apparatus. Without limiting the scope of the invention, this may include any combination of the aforementioned materials, which can be used to construct the base, arms, or any other support member.

An exemplary embodiment of the present invention, a workstation comprises a base including a universal coupling mechanism adapted to securely couple to a plurality of different types of chairs. Said universal coupling mechanism is adapted to securely couple to a vertical support member of said plurality of chairs. The base further includes a power interface to provide power to user articles, and a plurality of rollers attached to the base for transporting the invention. Extending vertically from the base and securely coupled to the base is a post. Coupled to the post are one or more support members, wherein each supporting member is adapted to support said user article. The support members are user adjustable in a substantially lateral and rotational direction, with a range substantially over 280 degrees.

A workstation with variable spatial configuration capabilities has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed is:

1. A workstation, comprising:

a chair platform adapted to support a chair;

a plurality of posts extending generally vertical from and securely coupled to said platform; and one or more supporting members coupled to said posts, wherein at least one of said supporting members is adapted to support a user article, and wherein at least one of said supporting members laterally and rotationally move about a vertical axis with a rotational range of substantially over 180 degrees;

wherein at least one of said supporting members further comprises a support surface configured to complementarily abut against said user article.

* * * * *